US009968208B2

(12) United States Patent
Brennan

(10) Patent No.: US 9,968,208 B2
(45) Date of Patent: May 15, 2018

(54) DISPLAY STAND AND CONSUMER SYSTEM WHICH ENCOURAGES A CONSUMER TO PURCHASE A SUSTAINABLE/ECO-FRIENDLY PRODUCT

(71) Applicant: Brian Roos Brennan, Verdi, NV (US)

(72) Inventor: Brian Roos Brennan, Verdi, NV (US)

( * ) Notice: Subject to any disclaimer, the term of this patent is extended or adjusted under 35 U.S.C. 154(b) by 197 days.

(21) Appl. No.: 14/756,015

(22) Filed: Jul. 21, 2015

(65) Prior Publication Data

US 2017/0020306 A1 Jan. 26, 2017

(51) Int. Cl.
*A47F 7/00* (2006.01)
*B42F 13/26* (2006.01)

(52) U.S. Cl.
CPC ..... *A47F 7/00* (2013.01); *B42F 13/26* (2013.01)

(58) Field of Classification Search
CPC ..... A47F 7/00; A47F 7/0007; A47F 7/0014; A47F 7/0021; A47F 7/0028; A47F 7/0035; A47F 7/0042; A47F 7/0057; A47F 7/0064; A47F 7/14; A47F 7/141; A47F 7/142; A47F 7/143; A47F 7/144; A47F 7/145; A47F 7/146; A47F 7/147; A47F 7/148; A47F 7/16; A47F 7/163; A47F 7/166
USPC ..... 211/42, 126.15
See application file for complete search history.

(56) References Cited

U.S. PATENT DOCUMENTS 226,857 A * 4/1880 Hoslins ..... A47F 7/145 211/181.1
660,264 A * 10/1900 Storm ..... A47F 5/005 211/184
2,082,214 A * 6/1937 Osten ..... A47F 7/163 211/71.01
3,044,631 A 7/1962 Greenman
3,149,727 A * 9/1964 Magers ..... A47F 7/144 211/133.1
3,288,544 A * 11/1966 Knecht ..... A47F 3/06 16/94 D (Continued)

FOREIGN PATENT DOCUMENTS

FR 2654601 A1 * 5/1991 ..... A47F 3/10

OTHER PUBLICATIONS

"Build Your Own Star Wars Lightsaber at Disneyland." LiquidSquid.com, Published Nov. 16, 2012. Web. Jun. 6, 2017. <https://laughingsquid.com/build-your-own-star-wars-lightsaber-at-disneyland/>.*

*Primary Examiner* — Joshua E Rodden

(57) ABSTRACT

The Eco Fit invention encourages a consumer to take part in significantly impacting environmental issues. Quick information can help with decisions reducing consumables. Consumers need to understand the difference between products designed to be more sustainable than the current consumables. The Smarter Way is analyzing the measurable much like ingredient labels of food products before the purchase. The display must contain indicia which informs the consumer of the carbon imprint for the product. This change over time can bring quality products to the market place that will have longer life spans with reduced costs and consumption. We can influence the process of reducing the manufacturer's energy costs, the purchase price, the transportation and the impact on our environment. Labels and displays can teach the value of greatly reducing consumerism and waste for subsequent generations. The Smarter Way is to show the costs and savings at the point of purchase.

10 Claims, 5 Drawing Sheets

(56) References Cited

U.S. PATENT DOCUMENTS

| | | | | | |
|---|---|---|---|---|---|
| 3,315,936 | A * | 4/1967 | Dautch | A47F 7/142 | 206/424 |
| 3,507,679 | A | 4/1970 | Metcalfe et al. | | |
| 4,074,451 | A * | 2/1978 | Jacobson | A47F 5/01 | 211/42 |
| 4,272,136 | A * | 6/1981 | Sengua | B25H 1/02 | 248/188.4 |
| 5,230,423 | A * | 7/1993 | Gellatly | A47F 5/114 | 206/764 |
| 5,292,015 | A * | 3/1994 | Bumbera | A47F 5/10 | 211/133.1 |
| 5,346,076 | A * | 9/1994 | Hart | G09F 15/005 | 211/49.1 |
| 7,350,649 | B1 | 4/2008 | Martens | | |
| 7,954,655 | B2 | 6/2011 | Virvo | | |
| 8,585,311 | B2 * | 11/2013 | Brennan | B42F 13/26 | 402/75 |
| 9,009,997 | B1 * | 4/2015 | Kemp | G09F 7/18 | 211/55 |
| 9,125,503 | B2 | 9/2015 | Hawkins | | |
| 9,204,739 | B2 | 12/2015 | Van Buskirk | | |
| 2009/0151211 | A1 * | 6/2009 | Alyn | A47F 5/0807 | 40/605 |
| 2011/0314714 | A1 * | 12/2011 | Baxendale | A47F 7/14 | 40/606.03 |
| 2012/0305508 | A1 * | 12/2012 | Brozak | A47F 7/0021 | 211/85.5 |
| 2013/0325670 | A1 * | 12/2013 | Austin, III | G06Q 30/06 | 705/27.1 |

* cited by examiner

50

44
44-a
44-b
48-a
56

52

42-c
43
42-a
54
42-b 46-a
46-d
46-f
46-e
46-c 66
60
62
64

DISPLAY STAND AND CONSUMER SYSTEM WHICH ENCOURAGES A CONSUMER TO PURCHASE A SUSTAINABLE/ECO-FRIENDLY PRODUCT

FIELD OF THE INVENTION

This disclosure relates in general to a display stand that informs a consumer of the many advantages of buying a sustainable/eco-friendly, recyclable product. More particularly the invention pertains to a display stand and system which encourages a consumer not only to purchase the product for environmental purposes but also to assemble or disassemble the product at the point of sale for a reduced sales price.

BACKGROUND OF THE INVENTION

It has become clearly evident that we as a society must become educated and realize that each individual can make a great impact and help save our environment by purchasing products that are sustainable, recyclable and simply environmentally friendly. Statistics indicate that the average consumer is not educated and when purchasing a product the environmental impact is not of great concern. Most often the consumer will purchase a product simply due to the lesser sales price which is most unfortunate and also environmentally damaging. Therefore, there is a great need to provide a simple effective means of educating, communicating and encouraging the consumer to purchase the product not only for environmental purposes but also to purchase the item to save money.

Within the known prior art there are many types of display stands and unlimited types of sustainable products. However, the typical display stand does not communicate and/or inform the consumer of the product's environmental impact. More importantly typical display stands do not offer a reduced sales price if the consumer assembles the product themselves. This is a very important factor when considering overall production, marketing, shipping costs, etc. For example, if the components of a product can be assembled by the consumer at the point of sale, this is a novel and cost effective solution heretofore not recognized, addressed nor resolved. Many products when assembled are bulky and shipping and retail floor space are critical factors when considering overall business expenses. Therefore, the present invention provides a new display stand and consumer system which resolves numerous issues associated with the known prior art.

OBJECTS AND ADVANTAGES OF THE PRESENT INVENTION

It is therefore a primary object of the present invention to provide a display stand and consumer system that is cost effective for the manufacturer, the retailer and the consumer.

A further object of the present invention is to provide a display stand and consumer system that is environmentally friendly.

Another object of the present invention is to provide a display stand and consumer system having consumer informational indicia which may be in the form of either an instructional pamphlet, written instructions for assembly/disassembly of the product with photos, an audio/video display, a quick reader code, an icon or the like which informs the consumer of the carbon footprint for the associated product, or combinations thereof.

Yet another object of the present invention is to provide a display stand and consumer system that is aesthetically pleasing and also gets the consumers attention due to its uniqueness.

Still another object of the present invention is to provide a display stand and consumer system that saves the retailer valuable floor space.

A most important object of the present invention is to provide a display stand and consumer system that allows the consumer to easily assemble or disassemble the product at the point of sale for a reduced sales price.

Other objects and advantages will become apparent when taken into consideration with the following specification.

DETAILED DESCRIPTION OF THE DRAWINGS

Figure 1:
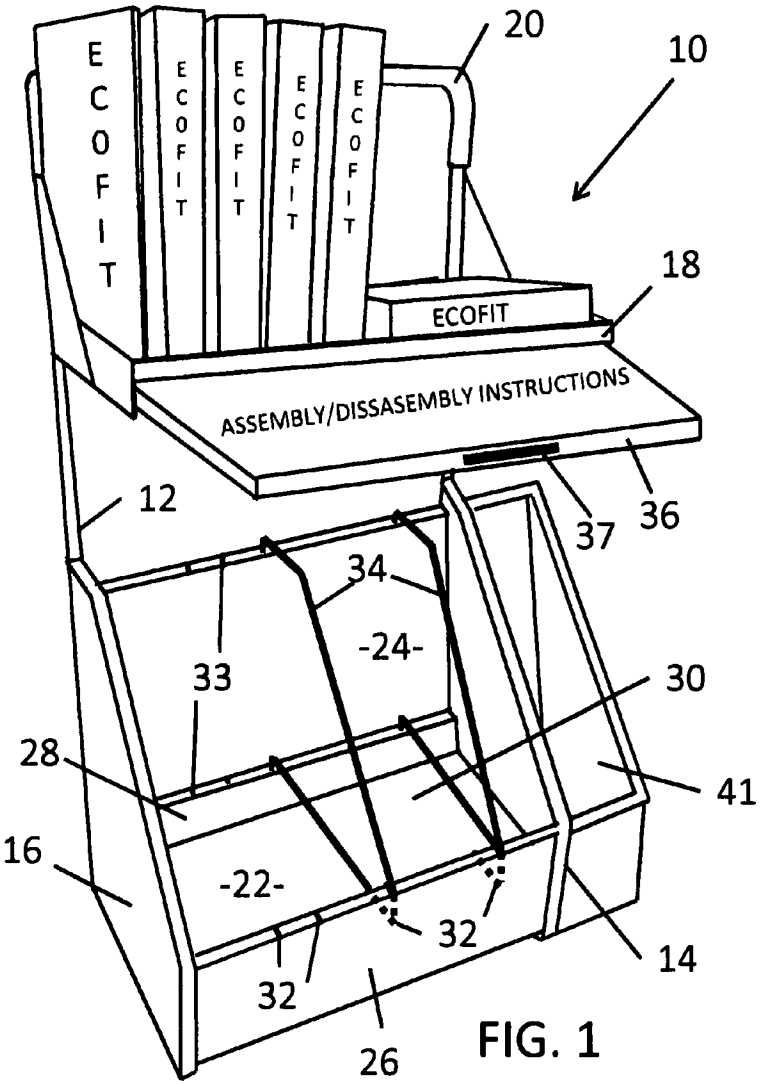
FIG. 1 is substantially a perspective overview of the display stand and consumer system of the present invention.

Referring now in detail to the drawings wherein like characters refer to like elements throughout the various views. The present invention is a display stand and consumer system. It is to be understood the display stand (10) of the present invention is not to be limited to the embodiment as depicted herein as numerous variations are inherent. Therefore the display stand (10) as depicted herein is only exemplary of one possible embodiment: It is to be further noted the display stand (10) can be made from any suitable material of engineering choice such as steel, aluminum, plastic, rubber, etc. and is not to be limited thereto. As depicted in FIG. 1, the display stand (10) includes a display support assembly (12) having a vertical right side support panel (14), a vertical left side support panel (16), at least one support shelf (18), a framework (20), a horizontal floor panel (22), a vertical rear wall (24), a front vertical support member (26) and a rear vertical support member (28).

Each vertical support panel (14 & 16), and each vertical support member (26 & 28) in combination forming at least one compartment (30) for containment of components associated with the sustainable product (later described). The front vertical support member (26) having at least one or more slots (32) each of which extend a short distance downward from a top edge thereof and are in open communication with the at least one compartment (30). The rear vertical support member (28) and the vertical rear wall (24) each have at least one hole (33) on the top edge thereof.

The display stand (10) further includes at least one partition implement (34) for partitioning the compartment (30) into adjustable variable different sized sections allowing for each of the components of the product to be aesthetically pleasingly displayed, organized and arranged separately. The partition implement (34) being of a novel shape and size consisting of an integrally formed bar which is made from any suitable material of engineering choice, such as metal, aluminum, plastic, rubber or the like. The partition implement (34) having a first end and a second end each of which are substantially bent downward at a 90 degree angle forming first and second downward projecting pegs which are of a shape and size to be removeably inserted downwardly into holes (33). The partition implement (34) further consisting of an elongated horizontal lower section which is of a length to extend in alignment from one of the holes (33) associated with vertical support member (28) to one of the slots (32) within the front vertical support (28). The elongated horizontal lower section having an end portion which is bent at a 90 degree angle upward forming a short leg which is of a shape and size to be slideably positioned within one of the slots (32). The short leg extending upward at an obtuse angle approximately 130 degrees forming an intermediate section. The intermediate section ending in a horizontal extension section terminating at the second downward projecting peg. It is to be noted the first and second downward projecting pegs are not in vertical alignment. Whereby, when the partition implement (34) is positioned in place within the slot (32) and the pegs are positioned within the holes (33) the partition implement (34) functions to provide a support means for components associated with the product of which are situated within the compartment (30).

The display stand (10) may further include optional features of engineering choice. For example, the display stand (10) may include an assembly/disassembly surface structure in the form of a sliding pull-out shelf (36) having a handle (37), or the like. Whereby, a consumer at the point of sale can easily position components of the product onto the sliding pull-out shelf (36) and either assemble the product or disassemble the product themselves.

Figure 2:
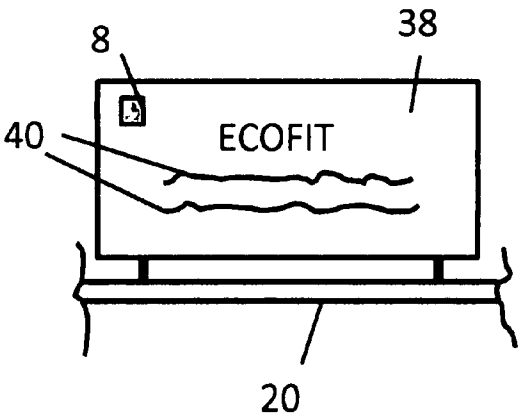
FIG. 2 is substantially a front view depicting the display panel associated with the present invention.

Yet another optional feature may include a display panel (38) for display of consumer informational indicia (40) thereon as depicted in FIG. 2. It is to be understood the consumer informational indicia (40) can be of any suitable type of engineering choice. For example, the consumer informational indicia (40) can be in the form of either an instructional pamphlet, written instructions for assembly/disassembly of the product with photos, an audio/video display, a quick reader code, an icon or the like which informs the consumer of the carbon footprint for the associated product, or combinations thereof.

Whereby; the consumer is encouraged to purchase the sustainable product for sustainability advantages, plus the informational indicia encourages the consumer to assemble the product for a reduced sales price and then recycle the multiple components accordingly.

The display stand (10) and consumer system may further include at least 1 compartment (41) for deposit of the multiple components for recycling. Whereby, this further encourages the consumer to recycle the components at the point of sale if so desired. Also, the compartment (41) allows the department store or the like to easily remove the components therefrom and deposit the components into their own recyclable disposal bins or the like.

It is to be understood the display stand (10) and consumer system of the present invention is novel as it's intended use and features interact with the consumer in a manner heretofore not taught, addressed, recognized or suggested within the known prior art. It is to be further understood the display stand (10) and consumer system of the present invention is usable and functional for substantially any type of product of engineering choice. The only requirement for the product is that it can be easily assembled/disassembled (no tools required) by the consumer at the point of sale. Preferably the product is a sustainable product that is also recyclable. Therefore, the invention is not limited to a specific product and the following description of a suitable product is only exemplary of one possible product and embodiment.

Figure 3:
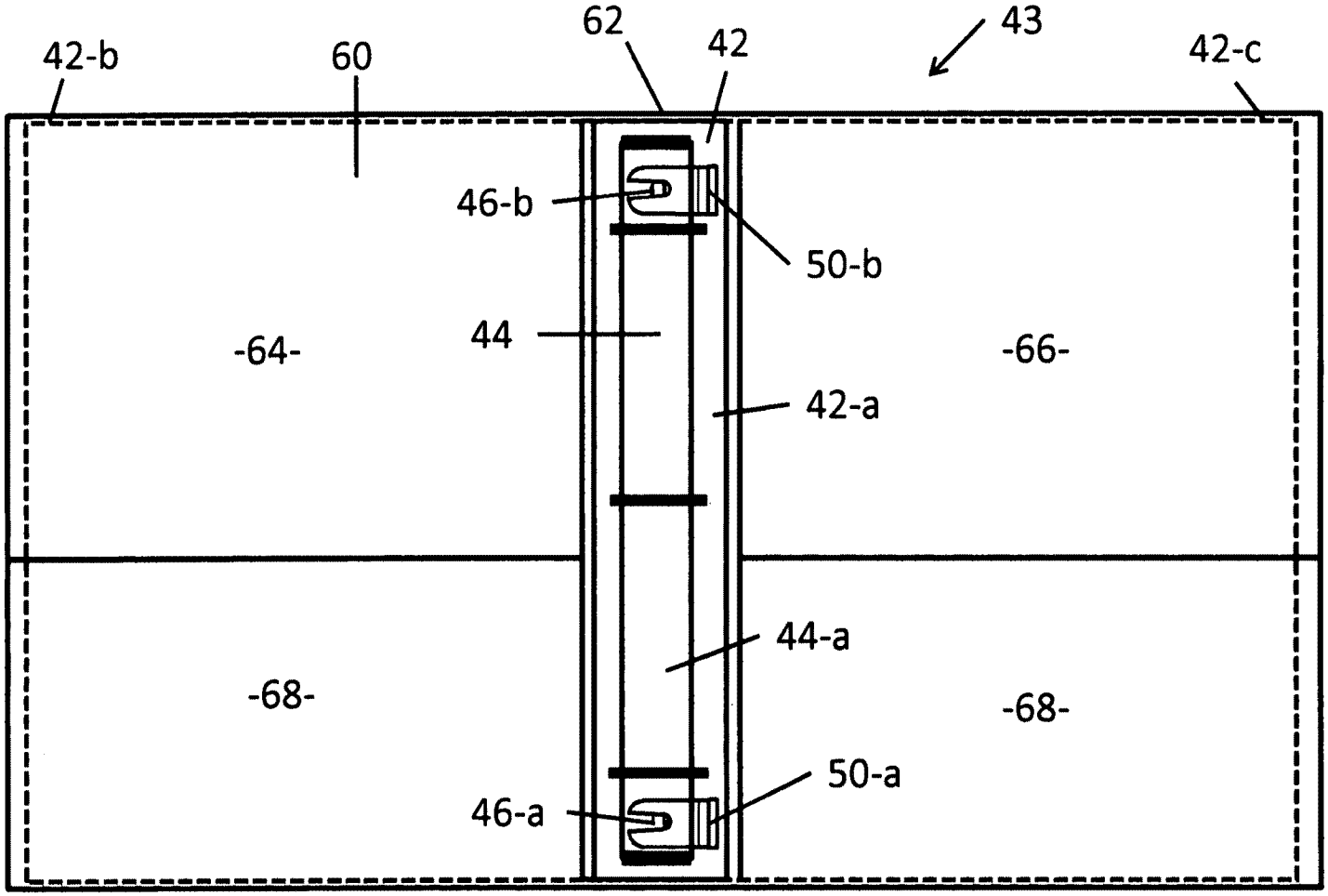
FIG. 3 is substantially an overview of the product associated with the present invention such as a ring binder.
Figures 4, 5, 6, 7, 8, 9:
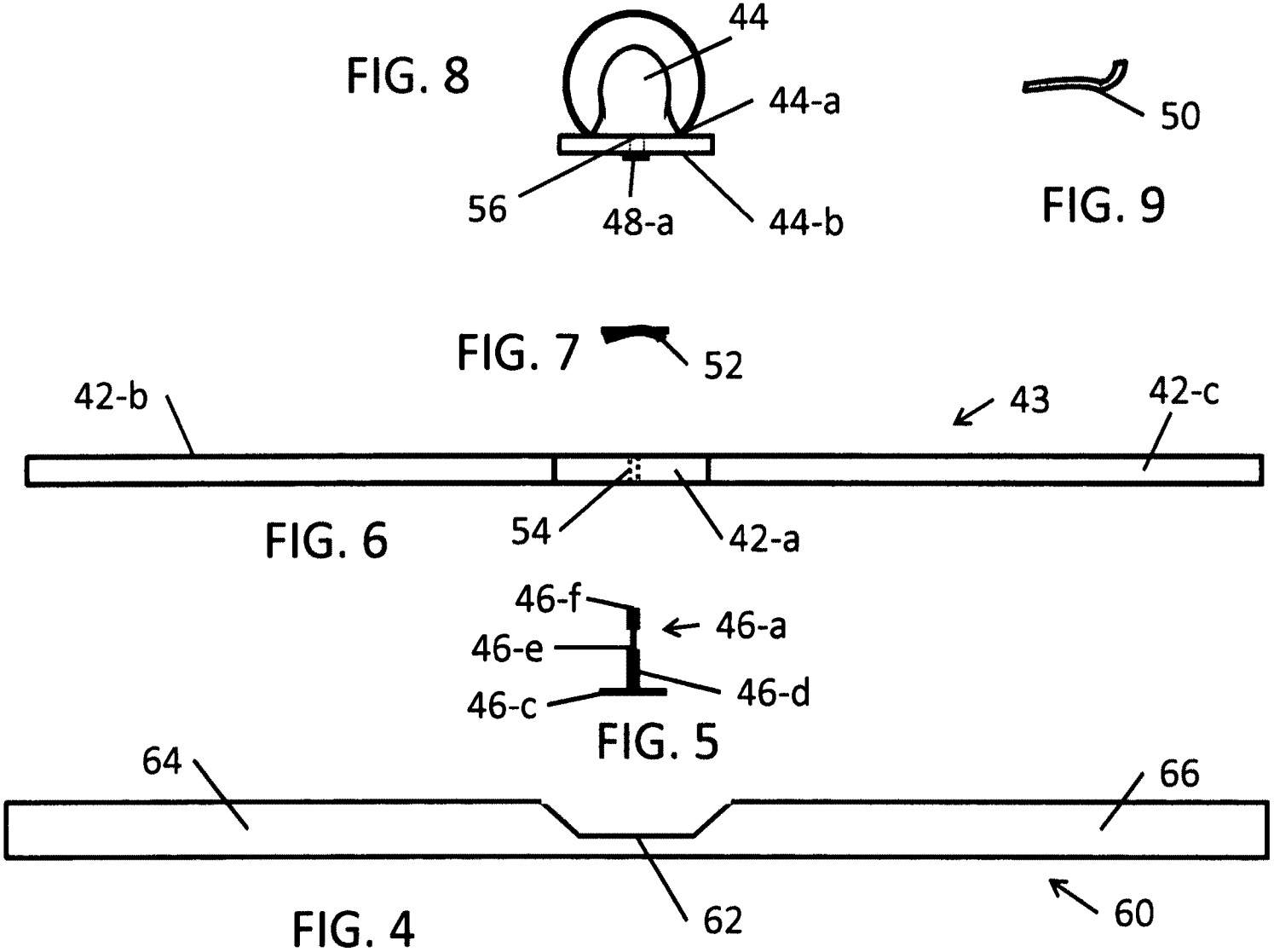
FIG. 4 is substantially an end view of the binder cover insert associated with the present invention.
FIG. 5 is substantially a front view of a first post associated with the present invention.
FIG. 6 is substantially an end view of the binder cover associated with the present invention.
FIG. 7 is substantially a side view of a spring washer associated with the present invention.
FIG. 8 is substantially an end view of a standard type ring metal.
FIG. 9 is substantially a side view of a first clip associated with the present invention.
Figure 10:
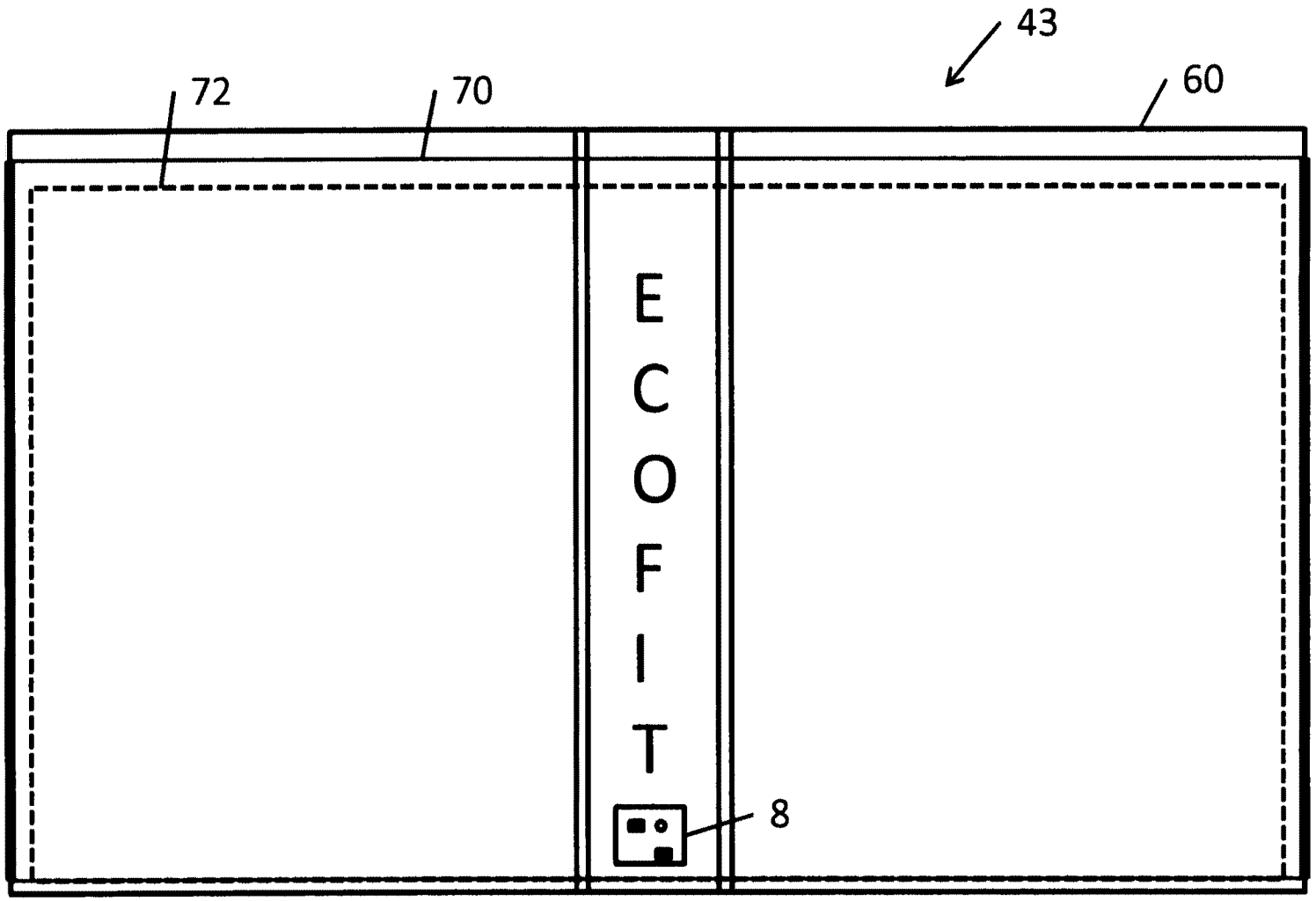
FIG. 10 is substantially an overview of the binder cover insert having an external transparent cover.
Figure 11:
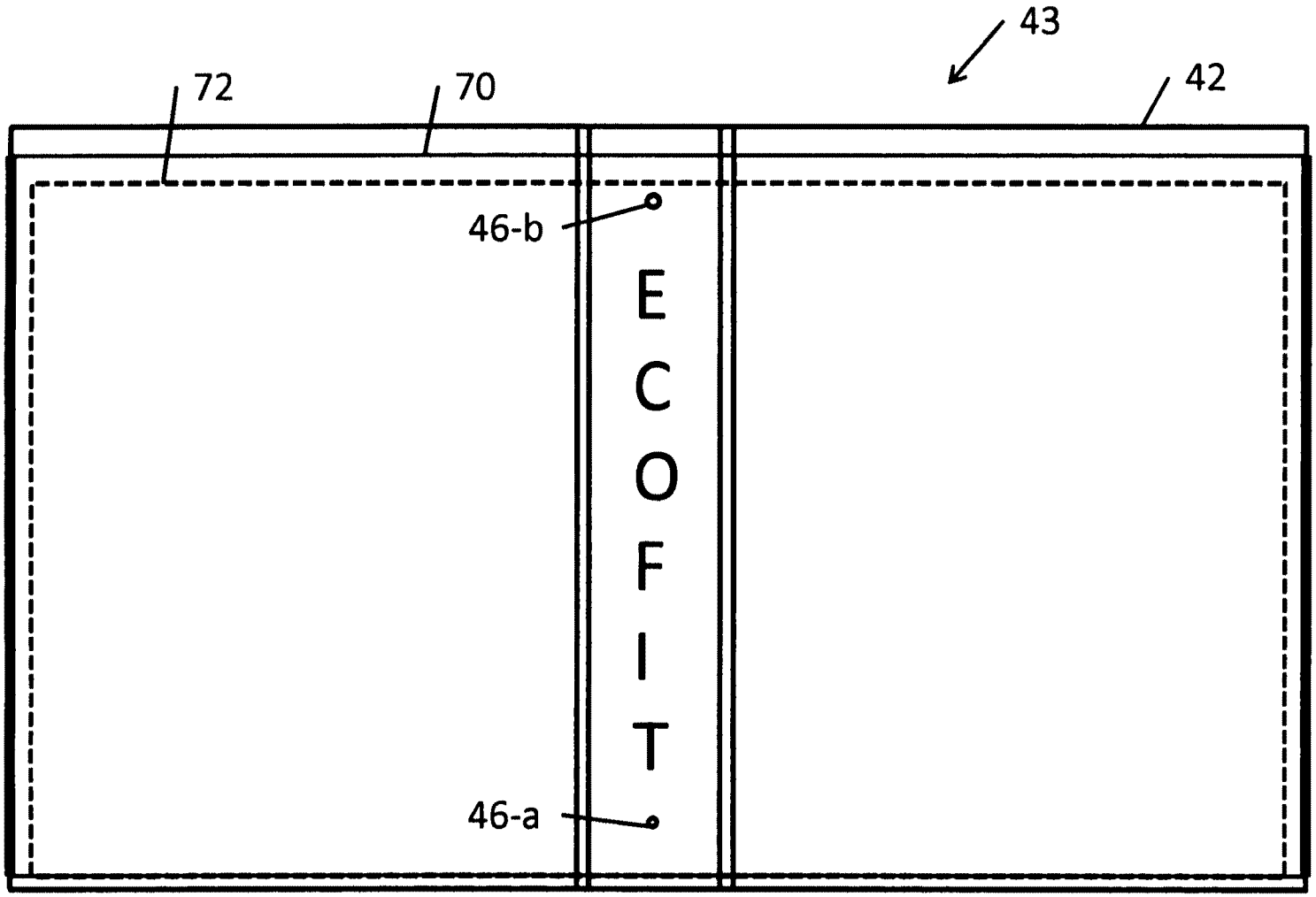
FIG. 11 is substantially an overview of the binder cover having an external transparent cover.

As depicted in FIGS. 3, 10 & 11, an example of a suitable product for this disclosure is substantially a paper 3-ring binder (43) formed from multiple components each of which are made from recyclable material of engineering choice. The noted multiple components including in combination a binder cover (42), an elongated horizontal ring metal (44), a first post (46-*a*), a second post (46-*b*) a first press-stud (48-*a*) (only one depicted in FIG. 8), a second press stud (not shown), a first clip (50-*a*), a second clip (50-*b*), a first washer (52-*a*) (only one shown in FIG. 7) and a second washer (not shown). The binder cover (42) is integrally formed having an elongated horizontal central section (42-*a*), a first outwardly extending hinged side panel (42-*b*) and a second outwardly extending hinged side panel (42-*c*). The first outwardly extending hinged side panel (42-*b*) being opposed to the second outwardly extending hinged side panel (42-*c*) yet interconnected and spaced apart by the elongated horizontal central section (42-*a*). The elongated horizontal central section (42-*a*) having a first portion opposed to a second portion. The first portion having a first vertical aperture (54) there through, (only shown in FIG. 6) and the second portion having a second vertical aperture there through (not shown). As depicted in FIG. 5, the first post (46-*a*) having a rimmed bottom end (46-*c*), an upwardly extending post section (46-*d*), a recessed neck portion (46-*e*) and a top end (46-*f*). The upwardly extending post section (46-*d*) being slideably inserted upwardly into the first vertical aperture (54), the rimmed bottom end (46-*c*) functions as a stop means. The first washer (52) being downwardly positioned around the upwardly extending post section (46-*d*) then downwardly situated onto the first portion of the elongated horizontal central section (42-*a*). The second post (46-*b*) having a rimmed bottom end (46-*c*), an upwardly extending post section (46-*d*), a recessed neck portion (46-*e*) and a top end (46-*f*). The upwardly extending post section of the second post (46-*b*) being slideably inserted upwardly into the second vertical aperture. The second washer being downwardly positioned around the upwardly extending post section of said second post (46-*b*) then downwardly situated onto second portion of the elongated horizontal central section (42-*a*). It is to be noted as depicted in FIG. 6 only one vertical aperture (54) and one washer (52) are illustrated within the views. However, it is to be clearly understood there are two vertical apertures and two washers. Also, each washer (52) is preferably a spring washer or an 0-ring type or any other of engineering choice. It is to be understood the spring washer is very important as the noted press studs of the ring metal (44) tend to vary in length. As a result the clips (50) may not fit properly. Therefore, to resolve this problem during the assembly process the assembler presses downward on the ring metal (44) causing the spring washer to compress allowing the clip to be easily attached onto the recessed neck portion (46-*e*). Upon manual release of the downward pressure the spring washer is then decompressed thus applying slight pressure to the clip and assures a proper fit of the clip.

It is to be further understood that any suitable standard type of ring metal can be utilized thus the internal components of the ring metal are not herein described as there are numerous types of available ring metals and the ring metal itself is considered standard prior art.

However, as depicted in FIG. 8 the standard type of elongated horizontal ring metal typically includes a first vertical orifice (56) and a second vertical orifice (not shown) there through. The first vertical orifice (56) having the first press-stud (48-*a*) inserted upwardly there through which is frictionally retained therein. The second vertical orifice (not shown) having the second press-stud (not shown) inserted upwardly there through which is frictionally retained therein. The elongated horizontal ring metal (44) having a bottom surface (44-*a*) and a top surface (44-*b*). The first post (46-*a*) being slideably upwardly positioned into the first press-stud (48-*a*) resulting in the recessed neck portion (46-*e*) with the top end (46-*f*) protruding outwardly upwardly from the top surface (44-*a*) when the binder (43) is assembled. The second post (46-*b*) being slideably upwardly positioned into the second press-stud (not shown) resulting in the recess neck portion (46-*e*) with the top end 46-*f*) protruding outwardly upwardly from the top surface (44-*a*) when the binder (43) is assembled.

As depicted in FIG. 3 the first clip (50-*a*) is formed from a body member having a pair of outwardly protruding arms which form a U-shaped slot there between, respectively. The body member having an upraised tab forming a finger grip opposed to the pair of outwardly protruding arms. To manually assemble the binder (43) the U-shaped slot is first horizontally aligned with the recessed neck portion (46-*e*) of the first post (46-*a*) then slideably engaged into the recessed neck portion (46-*a*) until the first clip (46-*a*) is firmly affixed onto the top surface (44-*a*) within the recessed neck portion (46-*e*).

The second clip (50-*b*) being formed from a body member having a pair of outwardly protruding arms which form a U-shaped slot there between, respectively. The body member of the second clip (50-*b*) having an upraised tab forming a finger grip opposed to the pair of outwardly protruding arms of the second clip (50-*b*). The U-shaped slot of the second clip (50-*b*) being horizontally aligned with the recessed neck portion of the second post (46-*b*) then slideably engaged into the recessed neck portion of the second post (46-*b*) until the second clip (50-*b*) is firmly affixed onto the top surface (44-*a*) within the recessed neck portion of the second post (46-*b*). Whereby, the elongated horizontal ring metal (44) is removeably yet fixedly attached onto the elongated horizontal central section (42) of the binder cover (43).

The binder cover (42) is functional in itself, however as an optional feature the binder may further include a binder cover insert (60) having an elongated horizontal central segment (62), a first outwardly extending hinged receptacle (64), and a second outwardly extending hinged receptacle (66). The first outwardly extending hinged receptacle (64) being opposed to the second outwardly extending hinged receptacle (66) yet interconnected and spaced apart by the elongated horizontal central segment (62). The first outwardly extending hinged side panel (42-*b*) of the binder cover (43) being of a shape and size to be removeably slideably adjustably inserted into the first outwardly extending hinged receptacle (64) and the second outwardly extending hinged side panel (42-*c*) of the binder cover (43) being of a shape and size to be removeably slideably adjustably inserted into the second outwardly extending hinged receptacle (66). Another optional feature is to include at least one pocket (68) upon the binder cover insert (60) at a location of engineering choice.

As depicted in FIG. 10 a further optional feature of the display stand and consumer system of the present invention is to include upon the binder cover insert (60) an exterior transparent cover (70) which is fixedly attached onto at least two opposing edges of the binder cover insert (60). Whereby, allowing an advertising informational insert (72) to be slideably removeably inserted and retained in between the exterior transparent cover (70) and an external surface of the binder cover insert (60). As depicted in FIG. 11, as an alternative if the binder (43) does not include the binder cover insert (60), the binder cover (43) may include the exterior transparent cover (70) which is fixedly attached onto at least two opposing edges of the binder cover (43). It is to be understood the exterior transparent cover (70) may be fixedly attached by any suitable attachment means of engineering choice, such as by bonding or the like.

The sliding pull-out shelf (36) may also include indicia (40) thereon in the form of assembly/disassembly photo's or the like with instructions such as the following:

Assembly Instructions:

A; grasping manually the rimmed bottom end (46-*c*) of a first post (46-*a*);

B; positioning manually the top end (46-*f*) below the first vertical aperture (54);

C; inserting the first post (46-*a*) upwardly into the first vertical aperture (54);

D; repeating steps A-C with the second post (46-*b*) and the second aperture (not shown);

E; positioning the first washer (52) above the first post (46-*a*);

F; sliding the first washer (52) downward and onto the first post;

G; repeating steps E-G with the second washer (not shown) and second post (46-*b*);

H; positioning the ring metal (44) above each of the posts (46-*a* & 46-*b*) with each of the press-studs (48-*a*) (only one shown) being aligned with each of the posts (46-*a* & 46-*b*);

I; slideably engaging downward upon the ring metal (44) until each of the posts (46-*a* & 46-*b*) protrude upwardly and outwardly from within each of the press-studs (48-*a*) (only one shown);

J; grasping manually the upraised tab of the body member associated with the first clip (50-*a*);

K; aligning the outwardly protruding arms and U-shaped slot associated with the first clip (50) with the recessed neck portion (46-*e*) of the first post (46-*a*);

L; applying manual downward pressure upon the ring metal while simultaneously slideably inserting the first clip into position onto the first post (46-*a*) until the recessed neck portion of the first post (46-*a*) is engaged within the U-shaped slot associated with the first post (46-*a*);

M; repeating steps J-K with the second clip (50-*b*) and the second post (46-*b*); and;

N; releasing the downward pressure applied to the ring metal, thus allowing the spring washers to be decompressed and resiliently retaining each of the components in proper position and firmly attaching the ring metal (44) onto the binder cover (43).

Disassembly Instructions;

A; applying manual downward pressure upon the ring metal (44) while simultaneously grasping the upraised tab of the first clip (50-*a*) and removing the first clip (50-*a*) until disengaged;

B; repeating step A with the second clip (50-*b*);

C; releasing the downward pressure applied to the ring metal;

D; grasping and upwardly removing the ring metal (44);

E; removing each of the washers (52) (only one shown); and;

F; removing each of the posts (46-*a* & 46-*b*), thus the binder (43) is now disassembled and each of the components may easily be recycled, or replaced accordingly.

It can now be seen herein disclosed is a novel and unique display stand and consumer system heretofore not taught within the known prior art. The invention is cost effective for the manufacturer, the retailer and the consumer. The invention is environmentally friendly and interacts with the consumer in a new and novel manner.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by LETTERS PATENT is:

1. A display stand and consumer system comprising: a display support assembly; a sustainable product; and consumer informational indicia; said sustainable product being easily manually assembled/disassembled by a consumer, said sustainable product being made from multiple recyclable components, said consumer informational indicia is in the form of either an instructional pamphlet, written instructions for assembly/disassembly of said sustainable recyclable product with photos, an audio/video display, a quick reader code which informs the consumer of the carbon footprint for said sustainable recyclable product, an icon, or combinations thereof, said display support assembly having at least one compartment for deposit of said multiple recyclable components for recycling, said display support assembly having at least one compartment for containment of said multiple recyclable components, at least one partition implement for partitioning said at least one compartment for containment of said multiple recyclable components, at least one support shelf for display of said sustainable product when assembled, at least one assembly/disassembly surface structure and at least one display panel for display of said consumer informational indicia, whereby;

said consumer is encouraged to purchase said sustainable product for sustainability ecofriendly advantages, said informational indicia encourages said consumer to assemble said sustainable product for a reduced sales price and then recycle said multiple recyclable components.

2. The display stand and consumer system of claim 1 wherein said an assembly/disassembly surface structure is in the form of a sliding pull-out shelf having a handle, whereby:

said consumer at the point of sale can easily position said multiple recyclable components onto said sliding pull-out shelf and either assemble said product or disassemble said product themselves.

3. A display stand and consumer system comprising: a display support assembly; a sustainable product; and consumer informational indicia;

said sustainable product being easily manually assembled/disassembled by a consumer, said sustainable product being made from multiple recyclable components, said display support assembly having at least one compartment for containment of said multiple recyclable components, said display support assembly comprising in combination a vertical right side support panel; a vertical left side support panel; at least one support shelf; a framework; a horizontal floor panel; a vertical rear wall; a front vertical support member; a rear vertical support member; and at least one partition implement; each said vertical support panel with each said vertical support member in combination forming said at least one compartment for containment of said multiple recyclable components associated with said sustainable product, said front vertical support member having at least one or more slots each of which extend a short distance downward from a top edge thereof, said slots being in open communication with said at least one compartment for containment of said multiple recyclable components, said rear vertical support member having at least one hole on a top edge thereof, said vertical rear wall having at least one hole on a top edge thereof, said partition implement being an integrally formed bar having a first end and a second end, each said end being bent downward at a 90 degree angle forming a first downward projecting peg and a second downward projecting peg each of which are of a shape and size to be removeably inserted downwardly into said holes, said integrally formed bar further having an elongated horizontal lower section which is of a length to extend in alignment from one of said holes associated with said vertical support member to one of said slots within said front vertical support member, said elongated horizontal lower section having an end portion which is bent at a 90 degree angle upward forming a short leg which is of a shape and size to be slideably positioned within one of said slots, said short leg extending upward at an obtuse angle approximately 130 degrees forming an intermediate section, said intermediate section ending in a horizontal extension section terminating at said second downward projecting peg and said first downward projecting peg and said second downward projecting peg are not in vertical alignment, whereby:

when said partition implement is positioned in place said partition implement functions to provide a support means for said multiple recyclable components associated with said sustainable product of which are situated within said at least one compartment for containment of said multiple recyclable components, and said partition implement further functions to partition said at least one compartment for containment of said multiple recyclable components into adjustable variable different sized sections allowing for each of said multiple recyclable components associated with said sustainable product to be aesthetically pleasingly displayed, organized and arranged separately.

4. A display stand and consumer system comprising: a display support assembly; a recyclable binder; and consumer informational indicia; said recyclable binder being easily manually assembled/disassembled by a consumer, wherein said indicia encourages said consumer to assemble/disassemble said recyclable binder for a reduced sales price and then recycle said recyclable binder, said recyclable binder being made from multiple components, said multiple components being made from recyclable materials, said display support assembly having at least one compartment for containment of said multiple components, said multiple components in combination comprising: a binder cover; an elongated horizontal ring metal; a first post; a second post; a first press-stud, a second press stud; a first clip; a second clip; a first washer; and a second washer; said binder cover is integrally formed having an elongated horizontal central section; a first outwardly extending hinged side panel; a second outwardly extending hinged side panel; said first outwardly extending hinged side panel being opposed to said second outwardly extending hinged side panel yet interconnected and spaced apart by said elongated horizontal central section, said elongated horizontal central section having a first portion opposed to a second portion, said first portion having a first vertical aperture there through, said second portion having a second vertical aperture there through, said first post having a rimmed bottom end; an upwardly extending post section: a recessed neck portion; and a top end; said upwardly extending post section being slideably inserted upwardly into said first vertical aperture, said rimmed bottom end functions as a stop means, said first washer being downwardly positioned around said upwardly extending post section then downwardly situated onto said first portion, said second post having a rimmed bottom end; an upwardly extending post section; a recessed neck portion; and a top end, said upwardly extending post section of said second post being slideably inserted upwardly into said second vertical aperture, said second washer being downwardly positioned around said upwardly extending post section of said second post then downwardly situated onto said second portion, said elongated horizontal ring metal having a first vertical orifice and a second vertical orifice there through, said first vertical orifice having said first press-stud inserted upwardly there through which is frictionally retained therein, said second vertical orifice having said second press-stud inserted upwardly there through which is frictionally retained therein, said elongated horizontal ring metal having a bottom surface and a top surface, said first post being slideably upwardly positioned into said first press-stud resulting in said recessed neck portion with said top end protruding outwardly upwardly from said top surface, said second post being slideably upwardly positioned into said second press-stud resulting in said recess neck portion with said top end protruding outwardly upwardly from said top surface, said first clip being formed from a body member having a pair of outwardly protruding arms which form a U-shaped slot there between, said body member having an upraised tab forming a finger grip opposed to said pair of outwardly protruding arms, said U-shaped slot being horizontally aligned with said recessed neck portion of said first post then slideably engaged into said recessed neck portion until said first clip is firmly affixed onto said top surface within said recessed neck portion, said second clip being formed from a body member having a pair of outwardly protruding arms which form a U-shaped slot there between, said body member of said second clip having an upraised tab forming a finger grip opposed to said pair of outwardly protruding arms of said second clip, said U-shaped slot of said second clip being horizontally aligned with said recessed neck portion of said second post then slideably engaged into said recessed neck portion of said second post until said second clip is firmly affixed onto said top surface within said recessed neck portion of said second post, whereby;

said elongated horizontal ring metal is removeably yet fixedly attached onto said elongated horizontal central section of said binder cover.

5. The display stand and consumer system of claim 4 further including a binder cover insert, said binder cover insert having an elongated horizontal central segment, a first outwardly extending hinged receptacle, a second outwardly extending hinged receptacle, said first outwardly extending hinged receptacle being opposed to said second outwardly extending hinged receptacle yet interconnected and spaced apart by said elongated horizontal central segment, said first outwardly extending hinged side panel being of a shape and size to be removeably slideably adjustably inserted into said first outwardly extending hinged receptacle and said second outwardly extending hinged side panel being of a shape and size to be removeably slideably adjustably inserted into said second outwardly extending hinged receptacle.

6. The display stand and consumer system of claim 5 wherein said binder cover insert further includes at least one pocket.

7. The display stand and consumer system of claim 5 wherein said binder cover insert further includes an exterior transparent cover which is fixedly attached onto at least two opposing edges of said cover insert, whereby:

allowing an advertising informational insert to be slideably removeably inserted and retained in between said exterior transparent cover and an external surface of said binder cover.

8. The display stand and consumer system of claim 5 further includes the consumer informational indicia including the following assembly instructions:

A; grasping manually the rimmed bottom end of said first post;

B; positioning manually the top end below said first vertical aperture;

C; inserting said first post upwardly into said first vertical aperture;

D; repeating steps A-C with said second post and said second aperture;

E; positioning said first washer above said first post;

F; sliding said first washer downward and onto said first post;

G; repeating steps E-G with said second washer and said second post;

H; positioning said ring metal above each of said posts with each of said press-studs being aligned with each of said posts;

I; slideably engaging downward upon said ring metal until each of said posts protrude upwardly and outwardly from within each of said press-studs;

J; grasping manually said upraised tab of said body member associated with said first clip;

K; aligning said outwardly protruding arms and said U-shaped slot associated with said first clip with said recessed neck portion of said first post;

L; applying manual downward pressure upon said ring metal while simultaneously slideably inserting said first clip into position onto said first post until said recessed neck portion of said first post is engaged within said U-shaped slot associated with said first post;

M; repeating steps J-K with said second clip and said second post;

and;

N; releasing said downward pressure applied to said ring metal, thus allowing each said washer to be decompressed and resiliently retain each of said multiple components in proper position and firmly attach said ring metal onto said binder cover.

9. The display stand and consumer system of claim 5 further includes the consumer informational indicia including the following disassembly instructions:

A; applying manual downward pressure upon said ring metal while simultaneously grasping said upraised tab of said first clip and removing said first clip until disengaged;

B; repeating step A with said second clip;

C; releasing said downward pressure applied to said ring metal;

D; grasping and upwardly removing said ring metal;

E; removing each said washer;

and;

F; removing each said post.

10. A display stand and consumer system comprising: a display support assembly; a sustainable product; consumer informational indicia; and said consumer informational indicia including a quick reader code; said quick reader code informs the consumer of the carbon footprint for said sustainable product and said sustainable product being easily manually assembled/disassembled by said consumer at the point of sale, whereby;

said informational indicia additionally encourages said consumer to assemble/disassemble said sustainable product for a reduced sales price and then recycle said sustainable product.

* * * * *